US011745212B1

(12) United States Patent
Forbes

(10) Patent No.: US 11,745,212 B1
(45) Date of Patent: Sep. 5, 2023

(54) INTERIOR AND EXTERIOR PAINTING METHOD AND APPARATUS

(71) Applicant: Ludlow D. Forbes, Elizabeth, NJ (US)

(72) Inventor: Ludlow D. Forbes, Elizabeth, NJ (US)

( * ) Notice: Subject to any disclaimer, the term of this patent is extended or adjusted under 35 U.S.C. 154(b) by 0 days.

(21) Appl. No.: 18/124,262

(22) Filed: Mar. 21, 2023

(51) Int. Cl.

| | |
|---|---|
| ***B05C 1/08*** | (2006.01) |
| ***B05C 1/06*** | (2006.01) |
| ***B44C 7/06*** | (2006.01) |
| ***B44C 7/04*** | (2006.01) |
| ***B05C 15/00*** | (2006.01) |

(52) U.S. Cl.
CPC ..... *B05C 1/0813* (2013.01); *B05C 1/06* (2013.01); *B05C 15/00* (2013.01); *B44C 7/04* (2013.01); *B44C 7/06* (2013.01)

(58) Field of Classification Search
CPC ..... B05C 1/0813; B05C 15/00; B05B 16/00; B05B 12/1454; B05B 13/0431
See application file for complete search history.

(56) References Cited

U.S. PATENT DOCUMENTS

| | | | | |
|---|---|---|---|---|
| 3,847,112 | A * | 11/1974 | Wise | B05C 17/0333 118/705 |
| 5,201,953 | A * | 4/1993 | Lowry | B05B 13/005 239/149 |
| 2004/0247358 | A1* | 12/2004 | Cannell | B41J 3/407 400/29 |
| 2006/0275552 | A1* | 12/2006 | Vendlinski | B05B 13/04 118/300 |

* cited by examiner

*Primary Examiner* — Philip C Tucker
*Assistant Examiner* — Jimmy R Smith, Jr.
(74) *Attorney, Agent, or Firm* — Walter J. Tencza, Jr.

(57) ABSTRACT

An apparatus including a grid having a plurality of rows and columns; a base, to which the grid is configured to be fixed; a liquid container; and a liquid application device; wherein the liquid application device is removably attached to the grid and configured to move along the grid when attached to the grid; and wherein the liquid application device is connected to the liquid container so that it receives liquid from the liquid container. The liquid application device may include a brush, a roller, and/or a spray device. The liquid may be paint or an adhesive, and for adhesive, wallpaper may be applied after the adhesive. The grid may be configured to be fixed parallel or perpendicular to the base, when the base is parallel to a floor surface, depending on whether the liquid is being applied to a vertical wall or to a ceiling.

20 Claims, 11 Drawing Sheets

INTERIOR AND EXTERIOR PAINTING METHOD AND APPARATUS

FIELD OF THE INVENTION

This invention relates to improved methods and apparatus concerning painting devices.

BACKGROUND OF THE INVENTION

Various painting devices are known in the prior art.

SUMMARY OF THE INVENTION

In at least one embodiment, an apparatus is provided comprising: a grid having a plurality of rows and columns; a base, to which the grid is configured to be fixed; a paint container; and a painting device; wherein the painting device is removably attached to the grid and configured to move along the grid when attached to the grid; and wherein the painting device is connected to the painting container so that the painting device is configured to receive paint from the painting container.

In at least one embodiment, the painting device may include a brush, a roller, and/or a spray device. The grid may be configured to be fixed parallel to the base, when the base is parallel to a floor surface on which the base rests. In another embodiment, the grid may be configured to be fixed perpendicular to the base, when the base is parallel to a floor surface on which the base rests. In at least one embodiment, the base has wheels for moving the base while the grid is fixed to the base.

In at least one embodiment, an apparatus is provided including a grid having a plurality of rows and columns; a base, to which the grid is configured to be fixed; an adhesive container; and an adhesive application device; wherein the adhesive application device is removably attached to the grid and configured to move along the grid when attached to the grid; and wherein the adhesive application device is connected to the painting container so that the adhesive application device is configured to receive adhesive from the adhesive container.

The apparatus may further include a roller for applying wall paper which is removably attached to the grid and configured to move along the grid when attached to the grid. The apparatus may further include a pressing device for applying pressure to wall paper wherein the pressing device is removably attached to the grid and configured to move along the grid when attached to the grid.

In at least one embodiment, a method is provided of automatically moving a liquid application device along a grid to apply a liquid to a surface in response to instructions from a computer processor as programmed by computer software in a computer memory; wherein the grid has a plurality of rows and columns; wherein the grid is fixed to a base; and wherein the liquid application device is configured to receive liquid from a container.

The liquid application device may include a brush, a roller, and/or a spray device.

The container used for the method may include a paint container; and a painting device. The container used for the method, may alternatively, include an adhesive container; and the liquid application device may be an adhesive application device.

The method may further include automatically moving a roller along the grid to roll out wallpaper on the surface after an adhesive has been applied to the surface by the adhesive application device.

The method may further include automatically moving a pressing device along the grid to press wallpaper to the surface after the roller has rolled out the wallpaper.

DETAILED DESCRIPTION OF THE DRAWINGS

Figure 1:
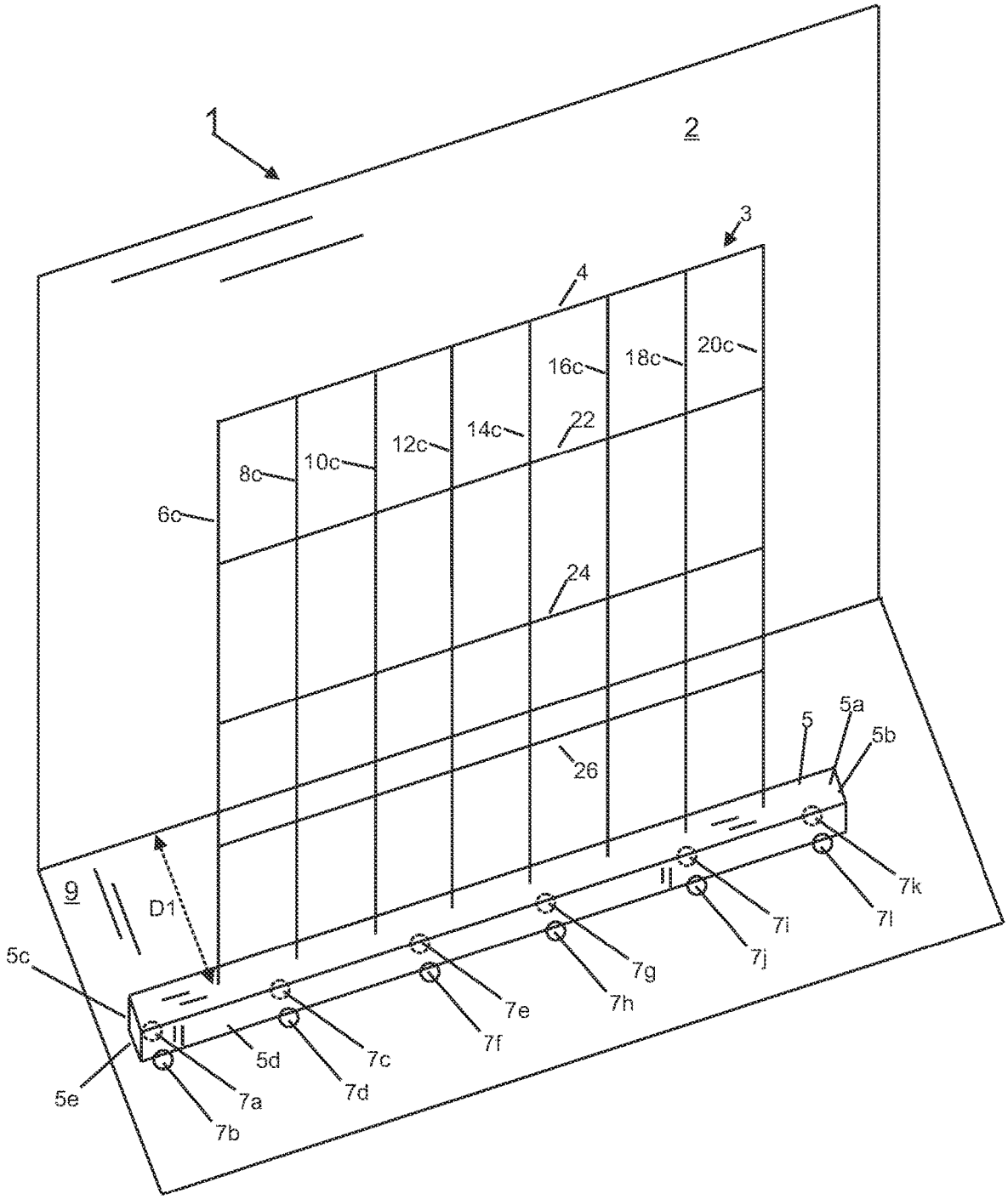
FIG. 1 shows a simplified diagram of a perspective view of an apparatus including a wall, a floor, a grid, and a movable cart to which the grid is removably attached in accordance with an embodiment of the present invention.

FIG. 1 shows a simplified diagram of a perspective view of an apparatus 1 including a wall 2, a floor 9, a grid 3, and a movable cart 5 to which the grid 3 is removably attached in accordance with an embodiment of the present invention.

The wall 2 and the floor 9 may be part of a room in a building, the rest of which is not shown in FIG. 1.

The grid 3 may include vertical members 6*c*, 8*c*, 10*c*, 12*c*, 14*c*, 16*c*, 18*c*, and 20, and horizontal members 4, 22, 24, and 26. Each of the vertical members 6*c*, 8*c*, 10*c*, 12*c*, 14*c*, 16*c*, 18*c*, and 20*s* is removably connected to each of the horizontal members 4, 22, 24, and 26, to form the grid 3. In at least one embodiment, it is critical that each of the vertical members or poles 6*c*, 8*c*, 10*c*, 12*c*, 14*c*, 16*c*, 18*c*, and 20*c*, and horizontal members 4, 22, 24, and 26 be of a sturdy material, such as regular stainless steel. In at least one embodiment, the base is made out of a heavy cast iron to prevent tipping.

The movable cart 5 functions as a base for the grid 3. The grid 3 is removably connected to the movable cart 5. The cart 5 has a body portion 5*a*, which has a top 5*b*, rear 5*c*, front 5*d*, and bottom 5*e*. The movable cart 5 has wheels or balls 7*a*, 7*b*, 7*c*, 7*d*, 7*e*, 7*f*, 7*g*, 7*h*, 7*i*, 7*j*, and 7*k* were are connected to the body portion so that they can rotate and allow cart 5 and attached grid 3 to be easily moved and/or rolled from one location to another. Each wheel or ball of wheels or balls 7*a*, 7*b*, 7*c*, 7*d*, 7*e*, 7*f*, 7*g*, 7*h*, 7*i*, 7*j*, and 7*k* may be separated from each adjacent wheel by a distance of about nine inches. The movable cart or base 5 is maneuverable like a centipede to allow the base 5 to maneuver itself into corners of a room to paint these difficult places to reach on one or more walls, such as wall 2.

Body portion or base 5*a* of the movable cart 5 may be made of a dense, heavy material, and may be larger than shown in FIG. 1, to provide a sturdy base to prevent the grid 3 from tipping over. The base or body portion 5*a* may be made of a heavy dense material, such as cast iron.

In FIG. 1, the cart 5 is positioned parallel to the wall 2, such that the grid 3 is a distance of D1 apart from the wall 2.

Figure 2:
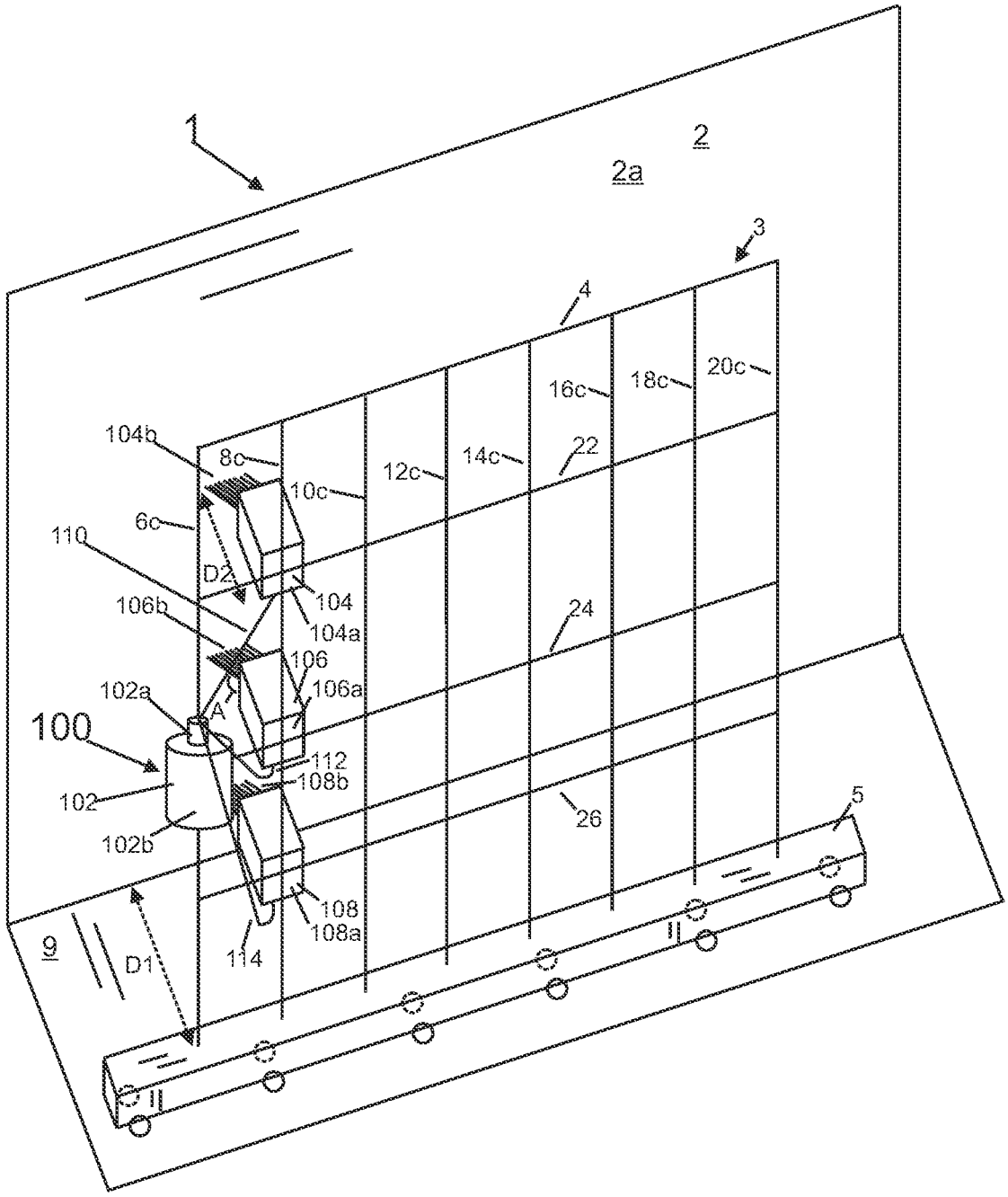
FIG. 2 shows a simplified diagram of a perspective view of the apparatus of FIG. 1, along with a first painting apparatus, which is removably connected to the grid.

FIG. 2 shows a simplified diagram of a perspective view of the apparatus 1 of FIG. 1, along with a first painting apparatus 100, which is removably connected to the grid 3.

The first painting apparatus 100 includes paint supply device 102, which includes body portion container 102*b* and pump and nozzle device 102*a*. The first painting apparatus 100 also includes tubes 110, 112, and 114, which have one end connected to pump and nozzle device 102*a* and an opposite end connected to painting devices 104, 106, and 108, respectively.

Painting devices 104, 106, and 108 include body portions 104*a*, 106*a*, and 108*a* and plurality of bristle portions 104*b*, 106*b*, and 108*b*, respectively.

Figure 5:
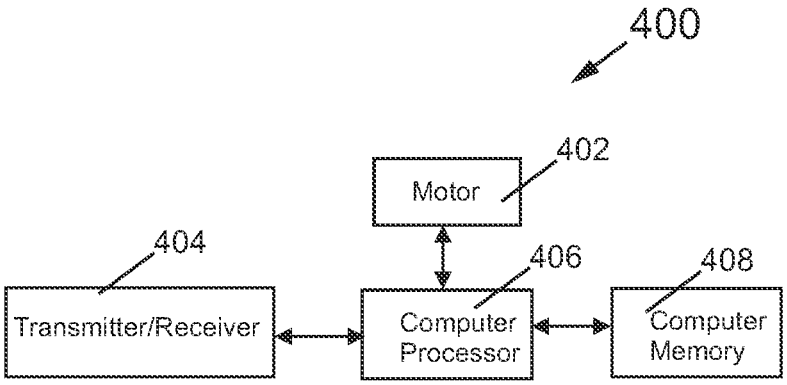
FIG. 5 shows a simplified block diagram of components for moving one or more body portions along the grid shown in FIG. 1.

The body portion container 102*b* of the paint supply device 102 includes a motor, such as motor 402, shown in FIG. 5, and may include components 404, 406, and 408. A motor 402 and components 404, 406, and 408 may be configured to be located and/or housed on or in each of body portions 102*b*, 104*a*, 106*a*, 108*a*, 202*b*, 204*a*, 206*a*, 208*a*, 302*b*, 304*a*, 306*a*, 308*a*, 502*b*, 504*a*, 510*a*, and 508*a*. The particular motor 402 is configured to move the particular body portion of body portions 102*b*, 104*a*, 106*a*, 108*a*, 202*b*, 204*a*, 206*a*, 208*a*, 302*b*, 304*a*, 306*a*, 308*a*, 502*b*, 504*a*, 510*a*, and 508*a* along the grid 3, and along any of vertical members 6*c*, 8*c*, 10*c*, 12*c*, 14*c*, 16*c*, 18*c*, and 20*c*, and along any of horizontal members 4, 22, 24, and 26, with each of the members 8*c*, 10*c*, 12*c*, 14*c*, 16*c*, 18*c*, and 20*c*, 4, 22, 24, and 26, functioning as a track along which each of the body portions of body portions 102*b*, 104*a*, 106*a*, 108*a*, 202*b*, 204*a*, 206*a*, 208*a*, 302*b*, 304*a*, 306*a*, 308*a*, 502*b*, 504*a*, 510*a*, and 508*a*, moves.

Similarly, or identically, the body portions 104*a*, 106*a*, and 108*a* move along any of vertical members 6*c*, 8*c*, 10*c*, 12*c*, 14*c*, 16*c*, 18*c*, and 20*c*, and along any of horizontal members 4, 22, 24, and 26, with each of the members 8*c*, 10*c*, 12*c*, 14*c*, 16*c*, 18*c*, and 20*c*, 4, 22, 24, and 26, functioning as a track along which the body portions 104*a*, 106*a*, and 108*a* move.

In operation, paint is supplied from the container 102*b* through the pump and nozzle device 102*a* to one or more of the tubes 110, 112, and 114, to the respective body portion 104*a*, 106*a*, and 108*a*, and then to the respective bristle portion 104*b*, 106*b*, and 108*b*, to paint the wall 2. In operation, the distance D1, of the grid 3 from the wall 2 (with the cart 5 parallel to the wall 2) should be about equal to the distance D2 from the grid 3 to the end of the bristle portion 104*b* (and to the end of bristle portions 106*b*, and 108*b*). In this manner, the distal or free ends of the bristle portions 104*b*, 106*b*, and 108*b* come in contact with a surface 2*a* of the wall 2, to allow the wall to be painted by the bristle portions 104*b*, 106*b*, and 108*b*.

The body portions 102*b*, 104*a*, 106*a*, and 108*a*, may include components permitting remote and/or automatic control of those portions to move those portions on the grid 3. Each of the body portions 102*b*, 104*a*, 106*a*, and 108*a* may include apparatus 400 shown in FIG. 5. The apparatus 400 may include a motor 402, a transmitter/receiver 404, a computer processor 406, and a computer memory 408. The transmitter/receiver 404 may receive one or more remote and/or automatic control signal(s) which determine which way one or more of the body portions 102*b*, 104*a*, 106*a*, and 108*a* will move on the grid 3. The computer processor 406 may process these one or more received signals from the transmitter/receiver 404 to cause the motor 402 to move the appropriate body portion of body portions 102*b*, 104*a*, 106*a*, and 108*a* in the appropriate direction along the grid 3, in accordance with computer programming stored in the computer memory 408.

The body portions 102*b*, 104*a*, 106*a*, and 108*a* may also be controlled through signals and/or electrical power provided through the grid 3. The body portions 102, 104*a*, 106*a*, and 108*a* may alternatively or additionally include batteries for providing power for a motor 402 (for each of body portions 102, 104*a*, 106*a*, and 108*a*) and/or for control circuitry, such as 404, 406, and 408 for each of body portions 102, 104*a*, 106*a*, and 108*a*.

The wheels 7*a*-7*k* shown in FIG. 1 may be wheels which are configured to be locked in place so that the cart 5 does not move when painting operation is occurring. The wheels 7*a*, 7*c*, 7*e*, 7*g*, 7*i*, and 7*k* are shown by dashed lines, because they would not be seen in the view of FIG. 1, since they are attached to side 5*c*, unless the body portion or base 5*a* is transparent.

Figure 3:
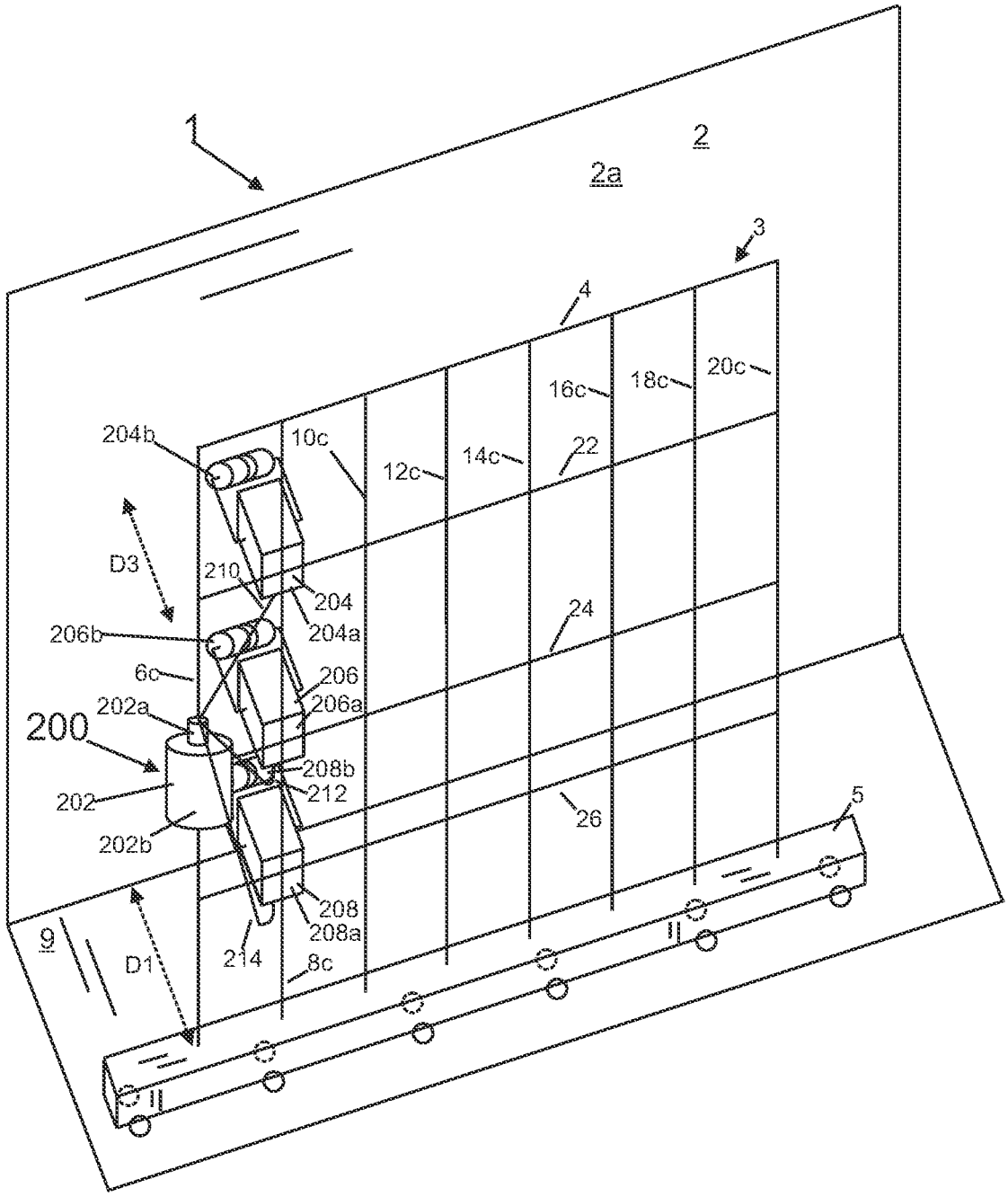
FIG. 3 shows a simplified diagram of a perspective view of the apparatus of FIG. 1, along with a second painting apparatus, which is removably connected to the grid.

FIG. 3 shows a simplified diagram of a perspective view of the apparatus 1 of FIG. 1, along with a second painting apparatus 200, which is removably connected to the grid 3.

The second painting apparatus 200 includes paint supply device 202 (which may be identical to paint supply device 102 in FIG. 2), which includes body portion container 202*b* and pump and nozzle device 202*a*. The first painting apparatus 200 also includes tubes 210, 212, and 214 (which may be identical to tubes 110, 112, and 112 shown in FIG. 2), which have one end connected to pump and nozzle device 202*a* and an opposite end connected to painting devices 204, 206, and 208, respectively.

Painting devices 204, 206, and 208 include body portions 204*a*, 206*a*, and 208*a* and plurality of roller portions 204*b*, 206*b*, and 208*b*, respectively.

The body portion container 202*b* of the paint supply device 202 includes a motor 402, referred to in FIG. 5, and moves along any of vertical members 6*c*, 8*c*, 10*c*, 12*c*, 14*c*, 16*c*, 18*c*, and 20*c*, and along any of horizontal members 4, 22, 24, and 26, with each of the members 8*c*, 10*c*, 12*c*, 14*c*, 16*c*, 18*c*, and 20*c*, 4, 22, 24, and 26, functioning as a track along which the body portion container 202*b* of the paint supply device 202 moves.

Similarly, or identically, the body portions 204*a*, 206*a*, and 208*a* move along any of vertical members 6*c*, 8*c*, 10*c*, 12*c*, 14*c*, 16*c*, 18*c*, and 20*c*, and along any of horizontal members 4, 22, 24, and 26, with each of the members 8*c*, 10*c*, 12*c*, 14*c*, 16*c*, 18*c*, and 20*c*, 4, 22, 24, and 26, functioning as a track along which the body portions 104*a*, 106*a*, and 108*a* move.

In operation, paint is supplied from the container 202*b* through the pump and nozzle device 202*a* to one or more of the tubes 210, 212, and 214, to the respective body portion 204*a*, 206*a*, and 208*a*, and then to the respective roller portion 204*b*, 206*b*, and 208*b*, to paint the wall 2. In operation, the distance D1 shown in FIG. 3, of the grid 3 from the wall 2 (with the cart 5 parallel to the wall 2) should be about equal to the distance D3, shown in FIG. 3, from the grid 3 to the end of the roller portion 204*b* (and to the end of roller portions 206*b*, and 208*b*). In this manner, the roller portions 204*b*, 206*b*, and 208*b* come in contact with a surface 2*a* of the wall 2, to allow the wall 2 to be painted by the roller portions 204*b*, 206*b*, and 208*b*. The roller portions 204*b*, 206*b*, and 208*b* are connected to body portions 204*a*, 206*a*, and 208*a*, in a manner which allows them to rotate with respect to body portions 204*a*, 206*a*, and 208*a*, respectively, for each by arms, having one end connected to the respective roller portion of 204*b*, 206*c*, and 208*b*, and an opposite end connected to the respective body portion of 204*a*, 206*a*, and 208*a*.

The body portions 202*b*, 204*a*, 206*a*, and 208*a*, may include components permitting remote and/or automatic control of those portions to move those portions on the grid 3. Each of the body portions 202*b*, 204*a*, 206*a*, and 208*a* may include apparatus 400 shown in FIG. 5. The transmitter/receiver 404 may receive one or more remote and/or automatic control signal(s) which determine which way one or more of the body portions 202*b*, 204*a*, 206*a*, and 208*a* will move on the grid 3. The computer processor 406 may process these one or more received signals from the transmitter/receiver 404 to cause the motor 402 to move the appropriate body portion of body portions 202*b*, 204*a*, 206*a*, and 208*a* in the appropriate direction along the grid 3, in accordance with computer programming stored in the computer memory 408.

The body portions 202*b*, 204*a*, 206*a*, and 208*a* may also be controlled through signals and/or electrical power provided through the grid 3. The body portions 202, 204*a*, 206*a*, and 208*a* may alternatively or additionally include batteries for providing power for a motor 402 (for each of body portions 202, 204*a*, 206*a*, and 208*a*) and/or for control circuitry, such as 404, 406, and 408 for each of body portions 202, 204*a*, 206*a*, and 208*a*.

Figure 4:
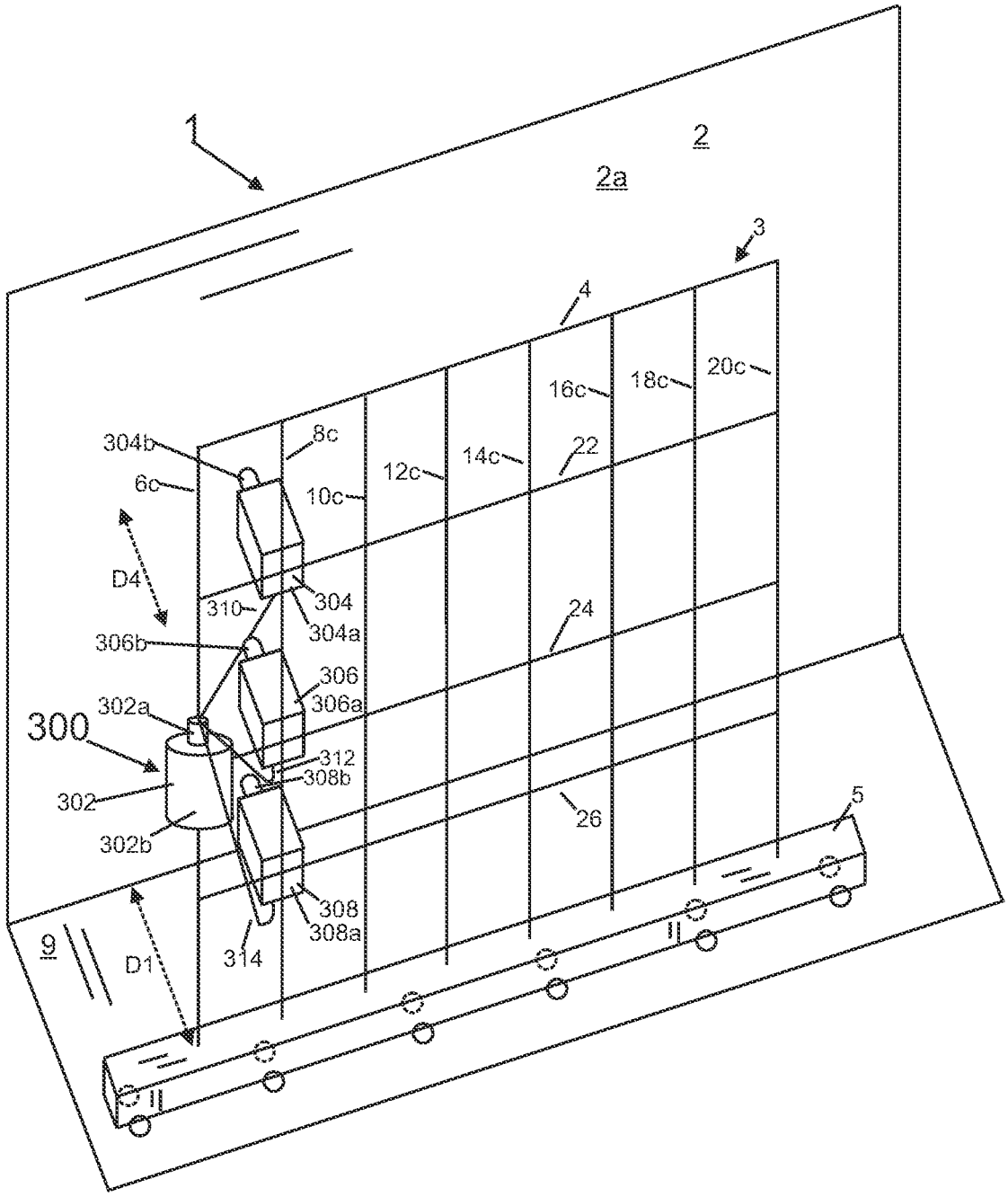
FIG. 4 shows a simplified diagram of a perspective view of the apparatus of FIG. 1, along with a third painting apparatus, which is removably connected to the grid.

FIG. 4 shows a simplified diagram of a perspective view of the apparatus 1 of FIG. 1, along with a third painting apparatus 300, which is removably connected to the grid 3.

The third painting apparatus 300 includes paint supply device 302 (which may be identical to paint supply device 102 in FIG. 2), which includes body portion container 302*b* and pump and nozzle device 302*a*. The first painting apparatus 300 also includes tubes 310, 312, and 314 (which may be identical to tubes 10, 112, and 112 shown in FIG. 2), which have one end connected to pump and nozzle device 302*a* and an opposite end connected to painting devices 304, 306, and 308, respectively.

Painting devices 304, 306, and 308 include body portions 304*a*, 306*a*, and 308*a* and plurality of spray device portions 304*b*, 306*b*, and 308*b*, respectively.

The body portion container 302*b* of the paint supply device 302 includes a motor 402, referred to in FIG. 5, and moves along any of vertical members 6*c*, 8*c*, 10*c*, 12*c*, 14*c*, 16*c*, 18*c*, and 20*c*, and along any of horizontal members 4, 22, 24, and 26, with each of the members 8*c*, 10*c*, 12*c*, 14*c*, 16*c*, 18*c*, and 20*c*, 4, 22, 24, and 26, functioning as a track along which the body portion container 302*b* of the paint supply device 302 moves.

Similarly, or identically, the body portions 304*a*, 306*a*, and 308*a* move along any of vertical members 6*c*, 8*c*, 10*c*, 12*c*, 14*c*, 16*c*, 18*c*, and 20*c*, and along any of horizontal members 4, 22, 24, and 26, with each of the members 8*c*, 10*c*, 12*c*, 14*c*, 16*c*, 18*c*, and 20*c*, 4, 22, 24, and 26, functioning as a track along which the body portions 304*a*, 306*a*, and 308*a* move.

In operation, paint is supplied from the container 302*b* through the pump and nozzle device 302*a* to one or more of the tubes 310, 312, and 314, to the respective body portion 304*a*, 306*a*, and 308*a*, and then to the respective roller portion 304*b*, 306*b*, and 308*b*, to paint the wall 2.

In operation, the distance D1 shown in FIG. 4, of the grid 3 from the wall 2 (with the cart 5 parallel to the wall 2) may be somewhat larger than the distance D4, shown in FIG. 4, from the grid 3 to the end of the spray portion 304*b* (and to the end of spray portions 306*b*, and 308*b*), i.e. because a spray device is used, for spray device portions 304*b*, 306*b*, and 308*b*, the end of 304*b*, 306*b*, and 308*b*, would typically not be in contact with the surface 2*a* of the wall 2.

The body portions 302*b*, 304*a*, 306*a*, and 308*a*, may include components permitting remote and/or automatic control of those portions to move those portions on the grid 3. Each of the body portions 302*b*, 304*a*, 306*a*, and 308*a* may include apparatus 400 shown in FIG. 5. The transmitter/receiver 404 may receive one or more remote and/or automatic control signal(s) which determine which way one or more of the body portions 302*b*, 304*a*, 306*a*, and 308*a* will move on the grid 3. The computer processor 406 may process these one or more received signals from the transmitter/receiver 404 to cause the motor 402 to move the appropriate body portion of body portions 302*b*, 304*a*, 306*a*, and 308*a* in the appropriate direction along the grid 3, in accordance with computer programming stored in the computer memory 408.

The body portions 302*b*, 304*a*, 306*a*, and 308*a* may also be controlled through signals and/or electrical power provided through the grid 3. The body portions 302, 304*a*, 306*a*, and 308*a* may alternatively or additionally include batteries for providing power for a motor 402 (for each of body portions 302, 304*a*, 306*a*, and 308*a*) and/or for control circuitry, such as 404, 406, and 408 for each of body portions 302, 304*a*, 306*a*, and 308*a*.

FIG. 5 shows a simplified block diagram of an apparatus 400 for moving one or more body portions along the grid 3 shown in FIG. 1.

After all walls, such as wall 2, and any other walls, and/or all rooms are painted, the lattice or grid 3 structure comprised of the horizontal members 4, 22, 24, and 26, and the vertical members or poles 6*c*, 8*c*, 10*c*, 12*c*, 14*c*, 16*c*, 18*c*, and 20*c*, can be taken apart and/or detached from each other and put into a box, container or bag for storage purposes, and/or the components can be cleaned.

Figure 6:
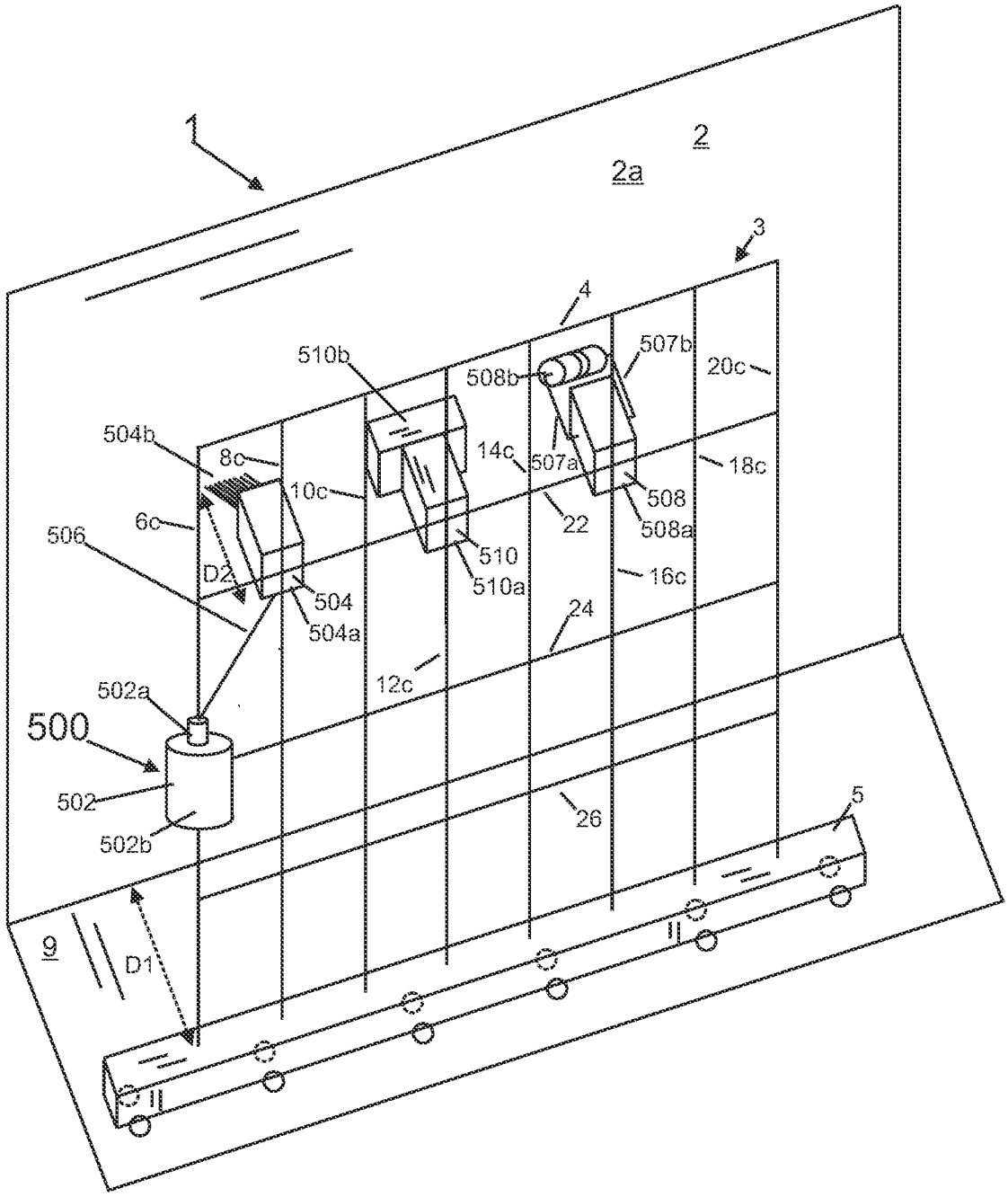
FIG. 6 shows a simplified diagram of a perspective view of the apparatus of FIG. 1, along with a wall paper application apparatus, which is removably connected to the grid.

FIG. 6 shows a simplified diagram of a perspective view of the apparatus 1 of FIG. 1, along with a wallpaper application apparatus 500, which is removably connected to the grid 3.

The wallpaper application apparatus 500 may include a container device 502, with container body portion 502*b* and a pump and/or nozzle device 502*a*. The container body portion 502*b* includes an inner chamber in which wallpaper adhesive or glue is stored.

The apparatus 500 also includes adhesive applicator device 504, which includes member 504*a* and bristles portion 504*b*. The nozzle and/or pump device 502*a* is connected by a tube to the member 504*b*.

In operation, the adhesive is supplied from an inner chamber of the typically cylindrical container body portion 502*b* through the nozzle and/or pump device 502*a*, through the tube 506, through member 504*a* and onto the bristles portion 504*b*. A free end of the bristles portion 504 opposite an end connected to the member 504*a* physically contacts the wall surface 2*a* to apply wall paper adhesive to the wall surface 2*a*.

The apparatus 500 further includes a wallpaper holder device 510 including member 510*a* and member 510*b*. The member 510*a* is connected to the grid 3.

The apparatus 500 further includes a roller device 508, which includes member 508*a* connected to the grid 3 and roller 508*b*, rotatably connected by arms 507*a* and 507*b* to the member 508*a*. After the wallpaper is applied to the adhesive on the wall surface 2*a* by the holder device 510, the roller device 508 rolls over the wallpaper located on the surface 2*a*, to smooth the wallpaper on the surface 2*a*.

Each of 502, 504, 508, and 510 may be moved anywhere on the grid 3 along the vertical members 6*c*, 8*c*, 10*c*, 12*c*, 14*c*, 16*c*, 18*c*, and 20*c*, and alone the horizontal members 4, 22, 24, and 26. Each of 502, 504, 508, and 510 may have the apparatus 400 located thereon to control movement remotely and/or automatically on the grid 3. Each of 502, 504, 508, and 510 may move along the tracks or effective tracks formed by the grid 3.

The body portions 502*b*, 504*a*, 508*a*, and 510*a* may also be controlled through signals and/or electrical power provided through the grid 3. The body portions 502*b*, 504*a*, 508*a*, and 510*aa* may alternatively or additionally include batteries for providing power for a motor 402 (for each of body portions 502*b*, 504*a*, 508*a*, and 510*a*) and/or for control circuitry, such as 404, 406, and 408 for each of body portions 502*b*, 504*a*, 508*a*, and 510*a*.

In FIGS. 2, 3, 4, 5, and 6, the container or container devices 102, 202, 302, and 502 are preferably located at attached to the opposite side of the grid 3, further away from the wall surface 2*a*, than the appropriate components of 104, 106, and 108 (for FIG. 2), 204, 206, and 208 (for FIG. 3), 304, 306, and 308 (for FIG. 4), and 504, 510, and 508 (for FIG. 6), which are located and attached on the opposite side of the grid 3, closer to the wall surface 2*a*, and this is done to help prevent and/or reduce the possibility of collisions between the various components.

In FIG. 2, there are three painting or paint brush devices 104, 106, and 108 shown, however, more paint brushes devices or less may be provided. Preferably at least two painting or paint brush devices are provided, similar or identical to each of 104, 106, and 108, however, in at least one embodiment, only one paint brush device may be provided.

In FIG. 3, there are three painting devices 204, 206, and 208 shown, however, more painting devices or less may be provided. Preferably at least two painting devices are provided, similar or identical to each of 204, 206, and 208, however, in at least one embodiment, only one painting device similar or identical to one of 204, 206, and/or 208 may be provided.

In FIG. 4, there are three painting devices 304, 306, and 308 shown, however, more painting devices or less may be provided. Preferably at least two painting devices are provided, similar or identical to each of 304, 306, and 308, however, in at least one embodiment, only one painting device similar or identical to one of 304, 306, and/or 308 may be provided.

Figure 7:
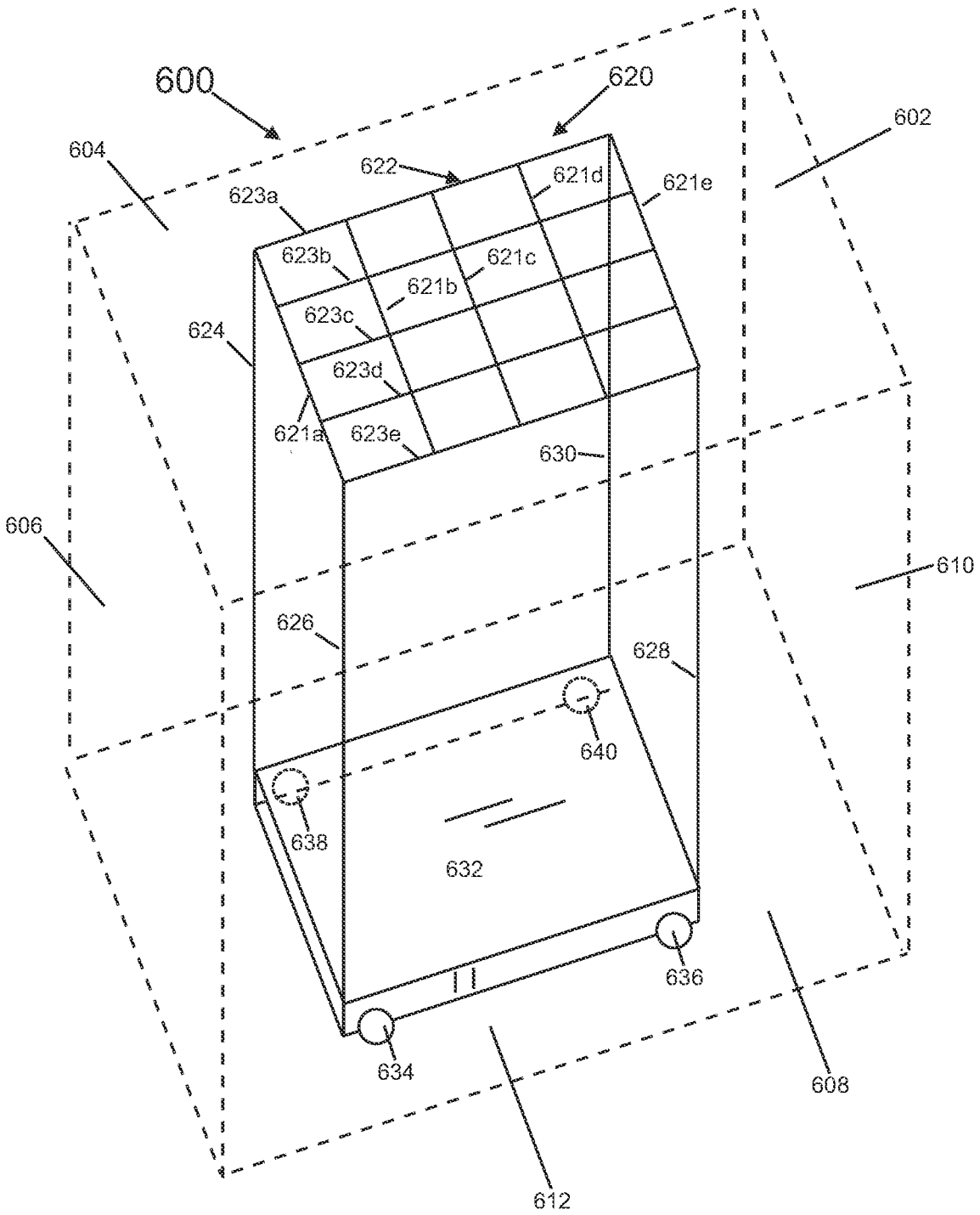
FIG. 7 shows a simplified diagram of a perspective view of an apparatus including a room, having a ceiling, a grid, and a movable cart to which the grid is removably attached in accordance with an embodiment of the present invention.

FIG. 7 shows a simplified diagram of a perspective view of an apparatus 600 including a room or which may be a room, having a horizontal ceiling 602, vertical walls 604, 606, 608, and 610, and horizontal floor 612. The apparatus 600 may further include a movable apparatus 620 which includes a horizontal grid 622, which is supported by vertical poles 624, 626, 628, and 630, on a movable cart or tray 632, having wheels or balls 634, 636, 638, and 640. The wheels 638 and 640 are shown in dashed lines because they typically would not be visible in the view of FIG. 7. The wheels 634, 636, 638, and 640 are mounted to the cart or tray 632, so that the wheels or balls 634, 636, 638, and 640 are able to rotate with respect to the cart or tray 632. The dashed line from wheel 638 and 640 is for descriptive purposes to show the approximate boundaries of a rear surface of the cart 632 which is not visible in FIG. 7. The grid 622 includes a plurality of rows and columns of tracks or pipes formed in a grid pattern.

Figure 8:
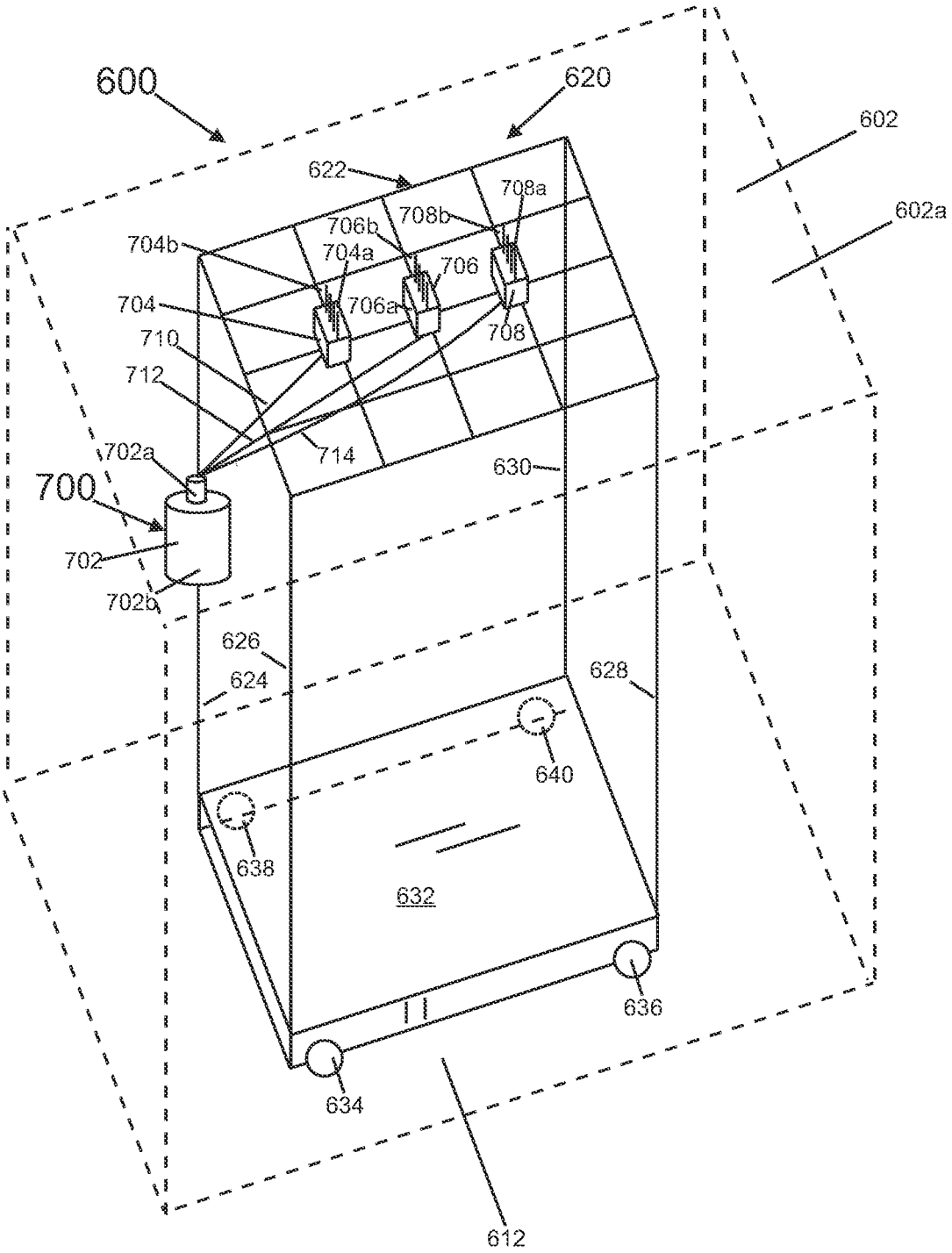
FIG. 8 shows a simplified diagram of a perspective view of the apparatus of FIG. 7, along with a fourth painting apparatus, which is removably connected to the grid, and/or one or more of a plurality of vertical posts.

FIG. 8 shows a simplified diagram of a perspective view of the apparatus 600 of FIG. 7, along with a fourth painting apparatus 700, which is removably connected to the grid 622 and/or one or more of the vertical posts 624, 626, 628, and 630.

The fourth painting apparatus 700 may be similar or identical to the first painting apparatus 100 shown in FIG. 2, except as will be described.

The fourth painting apparatus 700 includes paint supply device 702, which includes body portion container 702*b* and pump and nozzle device 702*a*. The fourth painting apparatus 700 also includes tubes 710, 712, and 714, which have one end connected to pump and nozzle device 702*a* and an opposite end connected to painting devices 704, 706, and 708, respectively.

Painting devices 704, 706, and 708 include body portions 704*a*, 706*a*, and 708*a* and plurality of bristle portions 704*b*, 706*b*, and 708*b*, respectively.

The body portion container 702*b* of the paint supply device 702 includes a motor, such as motor 402, shown in FIG. 5, and may include components 404, 406, and 408. A motor 402 and components 404, 406, and 408 may be configured to be located and/or housed on or in each of body portions 702*b*, 704*a*, 706*a*, 708*a*, 702*b*, 704*a*, 706*a*, 708*a*, 702*b*, 704*a*, 706*a*, 708*a*, 702*b*, 704*a*, 710*a*, and 708*a*. The particular motor 402 is configured to move the particular body portion of body portions 702*b*, 704*a*, 706*a*, 708*a*, 702*b*, 704*a*, 706*a*, 708*a*, 702*b*, 704*a*, 706*a*, 708*a*, 702*b*, 704*a*, 710*a*, and 708*a* along the grid 622, and along any of the column members 621*a*, 621*b*, 621*c*, 621*d*, 621*e*, and well as along any of the row members 623*a*, 623*b*, 623*c*, 623*d*, and 623*e*. The members 621*a-e* and the member 623*a-e* are preferably configured to be parallel to the horizontal ceiling 602, as shown in FIG. 7.

Each of the members 621*a-e* and 623*a-e* function as a track along which each of the body portions of body portions 704*a*, 706*a*, and 708*a* moves. The body portion 702*b* preferably moves along one of the poles, such as one of poles 624, 626, 628, and 630, such as along pol 624 as shown in FIG. 8.

In operation, paint is supplied from the container 702*b* through the pump and nozzle device 702*a* to one or more of the tubes 710, 712, and 714, to the respective body portion 704*a*, 706*a*, and 708*a*, and then to the respective bristle portion 704*b*, 706*b*, and 708*b*, to paint the ceiling 602. In operation, the distance of the grid 622 from the ceiling 602 (with the cart 632 and the grid 622 parallel to the ceiling 602 and to the floor 612) should be about equal to the distance from the grid 622 to the end of the bristle portion 704*b* (and to the end of bristle portions 706*b*, and 708*b*). In this manner, the distal or free ends of the bristle portions 704*b*, 706*b*, and 708*b* come in contact with a surface 602*a* of the ceiling 602, to allow the ceiling 602 to be painted by the bristle portions 704*b*, 706*b*, and 708*b*.

The body portions 702*b*, 704*a*, 706*a*, and 708*a*, may include components permitting remote and/or automatic control of those portions to move those portions on the grid 622. Each of the body portions 702*b*, 704*a*, 706*a*, and 708*a* may include apparatus 400 shown in FIG. 5. The apparatus 400 may include a motor 402, a transmitter/receiver 404, a computer processor 406, and a computer memory 408. The transmitter/receiver 404 may receive one or more remote and/or automatic control signal(s) which determine which way one or more of the body portions 704*a*, 706*a*, and 708*a* will move on the grid 622, and/or how the body portion 702*b* will move on one of the posts 624, 626, 628 or 630. The computer processor 406 may process these one or more received signals from the transmitter/receiver 404 to cause the motor 402 to move the appropriate body portion of body portions 702*b*, 704*a*, 706*a*, and 708*a* in the appropriate direction along the grid 622 and/or along one of the posts 62, 626, 628, and/or 630, in accordance with computer programming stored in the computer memory 408.

The body portions 702*b*, 704*a*, 706*a*, and 708*a* may also be controlled through signals and/or electrical power provided through the grid 622. The body portions 702, 704*a*, 706*a*, and 708*a* may alternatively or additionally include batteries for providing power for a motor 402 (for each of body portions 702, 704*a*, 706*a*, and 708*a*) and/or for control circuitry, such as 404, 406, and 408 for each of body portions 702, 704*a*, 706*a*, and 708*a*.

The wheels 634, 636, 638, and 640 shown in FIG. 8 may be wheels which are configured to be locked in place so that the cart 632 does not move when painting operation is occurring. The wheels 638 and 640 are shown by dashed lines, because they would not be seen in the view of FIG. 8, since they are attached to a side or rear, unless the body portion, base or cart 632 is transparent.

Figure 9:
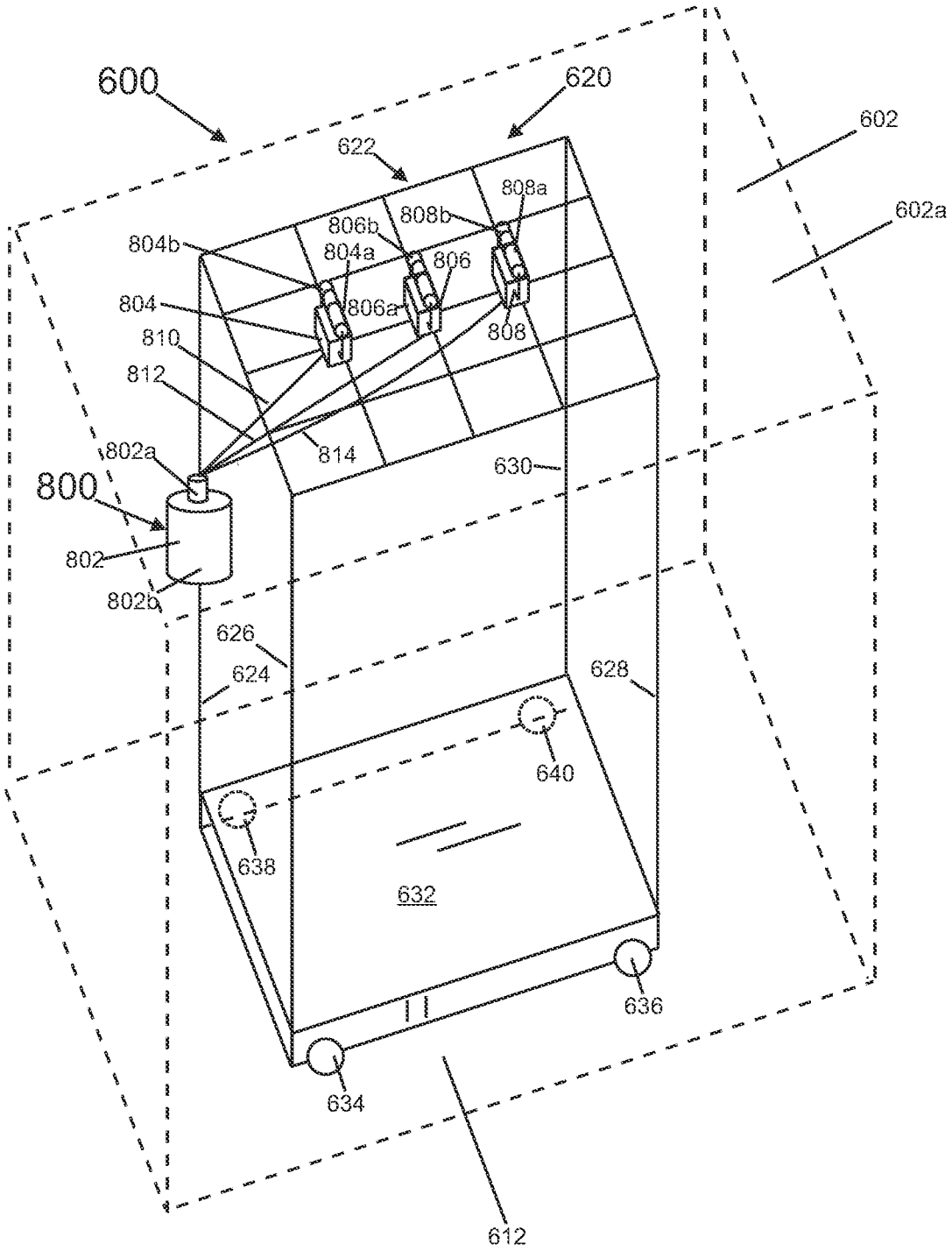
FIG. 9 shows a simplified diagram of a perspective view of the apparatus of FIG. 7, along with a fifth painting apparatus, which is removably connected to the grid, and/or a one or more of a plurality of vertical posts.

FIG. 9 shows a simplified diagram of a perspective view of the apparatus 600 of FIG. 7, along with a fifth painting apparatus 800, which is removably connected to the grid 622 and/or one of the posts 624, 626, 628, or 630.

The fifth painting apparatus 800 shown in FIG. 9, may be similar or identical to the second painting apparatus 200 shown in FIG. 3, except as will be described.

The fifth painting apparatus 800 includes paint supply device 802 (which may be identical to paint supply device 702 in FIG. 8), which includes body portion container 802*b* and pump and nozzle device 802*a*. The first painting apparatus 200 also includes tubes 810, 812, and 814 (which may be identical to tubes 710, 712, and 714 shown in FIG. 8), which have one end connected to pump and nozzle device 802*a* and an opposite end connected to painting devices 804, 806, and 808, respectively.

Painting devices 804, 806, and 808 include body portions 804*a*, 806*a*, and 808*a* and plurality of roller portions 804*b*, 806*b*, and 808*b*, respectively.

The body portion container 802*b* of the paint supply device 802 includes a motor 402, referred to in FIG. 5, and moves along any of vertical posts 624, 626, 628, or 630, such as vertical post 624, with the appropriate post functioning as a track along which the body portion container 802*b* of the paint supply device 802 moves.

Similarly, or identically, the body portions 804*a*, 806*a*, and 808*a* move along any of members 621*a-e* or 623*a-e* of the grid 622, shown in FIG. 7, with each of the members 621*a-e* or 623*a-e* acting as a track along which the body portions 804*a*, 806*a*, and 808*a* move.

In operation, paint is supplied from the container 802*b* through the pump and nozzle device 802*a* to one or more of the tubes 810, 212, and 814, to the respective body portion 804*a*, 806*a*, and 808*a*, and then to the respective roller (includes arms rotatably connecting roller to respective body portion) portion 804*b*, 806*b*, and 808*b*, to paint the ceiling 602. In operation, the distance of the grid 622 from the ceiling (with the cart 632 and the grid 622 parallel to the ceiling 602 and the floor 612) should be about equal to the distance from the grid 622 to the end of the roller portion 804*b* (and to the end of roller portions 806*b*, and 808*b*). In this manner, the roller portions 804*b*, 806*b*, and 808*b* come in contact with the surface 602*a* of the ceiling 602, to allow the ceiling 602 to be painted by the roller portions 804*b*, 806*b*, and 808*b*. The roller portions 804*b*, 806*b*, and 808*b* are connected to body portions 804*a*, 806*a*, and 808*a*, in a manner which allows them to rotate with respect to body portions 804*a*, 806*a*, and 808*a*, respectively, for each by arms, having one end connected to the respective roller portion of 804*b*, 806*c*, and 808*b*, and an opposite end connected to the respective body portion of 804*a*, 806*a*, and 808*a*.

The body portions 802*b*, 804*a*, 806*a*, and 808*a*, may include components permitting remote and/or automatic control of those portions to move those portions on the grid 622. Each of the body portions 802*b*, 804*a*, 806*a*, and 808*a* may include apparatus 400 shown in FIG. 5. The transmitter/receiver 404 may receive one or more remote and/or automatic control signal(s) which determine which way one or more of the body portions 802*b*, 804*a*, 806*a*, and 808*a* will move on the grid 622. The computer processor 406 may process these one or more received signals from the transmitter/receiver 404 to cause the motor 402 to move the appropriate body portion of body portions 802*b*, 804*a*, 806*a*, and 808*a* in the appropriate direction along the grid 622 or along one of the vertical posts 624, 626, 628 or 630, in accordance with computer programming stored in the computer memory 408.

The body portions 802*b*, 804*a*, 806*a*, and 808*a* may also be controlled through signals and/or electrical power provided through the grid 622 or through one or more of posts 624, 626, 628, and/or 630. The body portions 802*b*, 804*a*, 806*a*, and 808*a* may alternatively or additionally include batteries for providing power for a motor 402 (for each of body portions 802*b*, 804*a*, 806*a*, and 808*a*) and/or for control circuitry, such as 404, 406, and 408 for each of body portions 802*b*, 804*a*, 806*a*, and 808*a*.

Figure 10:
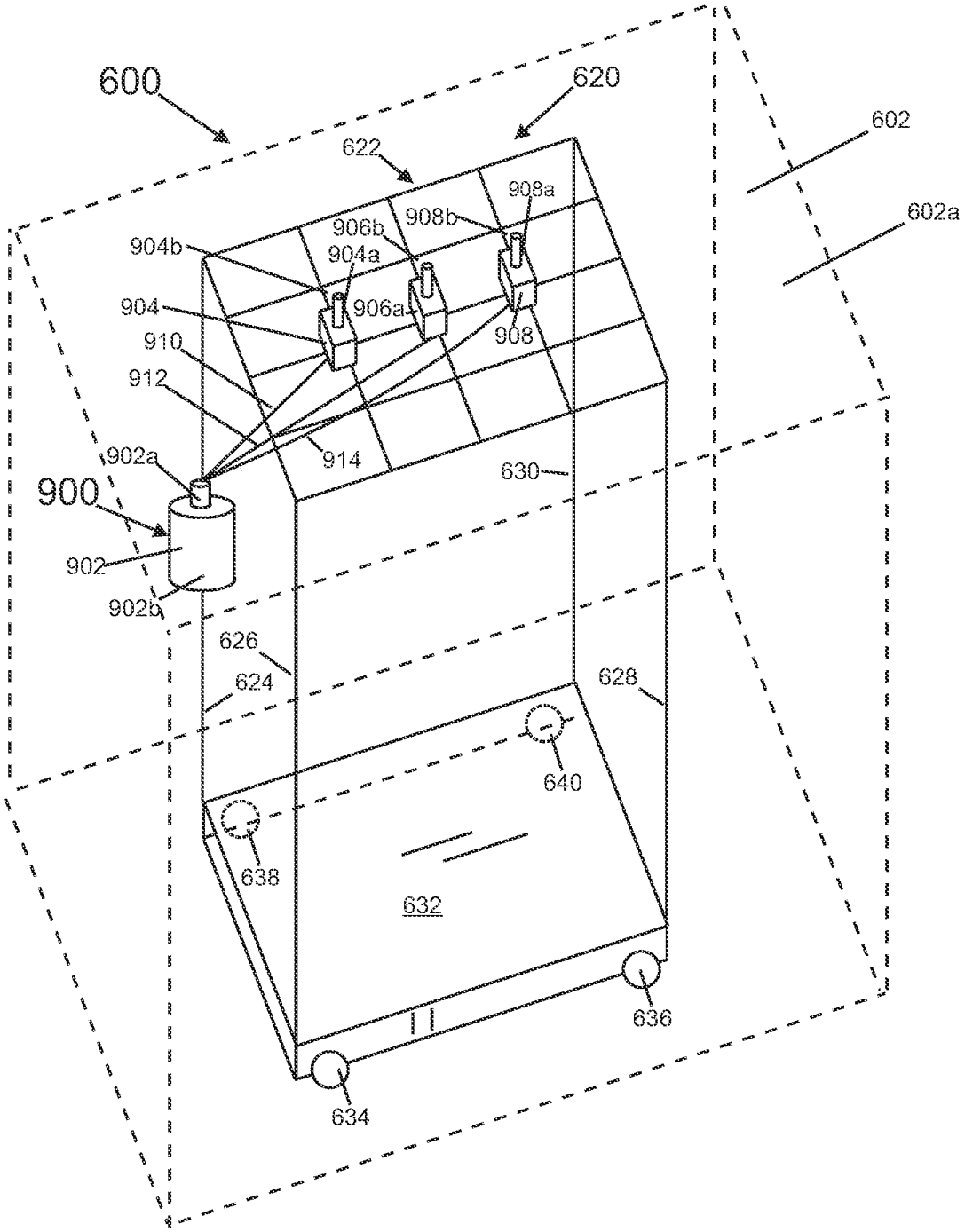
FIG. 10 shows a simplified diagram of a perspective view of the apparatus of FIG. 7, along with a sixth painting apparatus, which is removably connected to the grid; and/or one or more of a plurality of vertical posts.

FIG. 10 shows a simplified diagram of a perspective view of the apparatus 600 of FIG. 7, along with a sixth painting apparatus 900, which is removably connected to the grid 622 and/or one or more of vertical posts 624, 626, 628, and/or 630.

The sixth painting apparatus 900 may be similar or identical to the third painting apparatus 300 shown in FIG. 4, except as will be described.

The sixth painting apparatus 900 includes paint supply device 802 (which may be identical to paint supply device 702 in FIG. 8), which includes body portion container 902*b* and pump and nozzle device 902*a*. The first painting apparatus 900 also includes tubes 910, 912, and 914 (which may be identical to tubes 710, 7112, and 714 shown in FIG. 8), which have one end connected to pump and nozzle device 902*a* and an opposite end connected to painting devices 904, 906, and 908, respectively.

Painting devices 904, 906, and 908 include body portions 904*a*, 906*a*, and 908*a* and plurality of spray device portions 904*b*, 906*b*, and 908*b*, respectively.

The body portion container 902*b* of the paint supply device 902 includes a motor 402, referred to in FIG. 5, and moves along any of vertical posts 624, 626, 628, and/or 630, functioning as a track along which the body portion container 902*b* of the paint supply device 902 moves.

Similarly, or identically, the body portions 904*a*, 906*a*, and 908*a* move along any of members 621*a-e* or 623*a-e* of grid 622 shown in FIG. 7, with these members functioning as a track along which the body portions 904*a*, 906*a*, and 908*a* move.

In operation, paint is supplied from the container 902*b* through the pump and nozzle device 902*a* to one or more of the tubes 910, 912, and 914, to the respective body portion 904*a*, 906*a*, and 908*a*, and then to the respective spray device portion 904*b*, 906*b*, and 908*b*, to paint the ceiling surface 602*a* of the ceiling 602.

In operation, the distance of the grid 622 from the ceiling surface 602*a* (with the cart 632 and the grid 622 parallel to the ceiling surface 602*a*) will be somewhat larger than the distance from the grid 622 to the end of the spray portion 904*b* (and to the end of spray portions 906*b*, and 908*b*), i.e. because a spray device is used, for spray device portions 904*b*, 906*b*, and 908*b*, the end of 904*b*, 906*b*, and 908*b*, would typically not be in contact with the ceiling surface 602*a* of the wall ceiling 602.

The body portions 902*b*, 904*a*, 906*a*, and 908*a*, may include components permitting remote and/or automatic control of those portions to move those portions on the grid 622 and/or on the vertical posts 624, 626, 628, and/or 630. Each of the body portions 902*b*, 904*a*, 906*a*, and 908*a* may include apparatus 400 shown in FIG. 5. The transmitter/receiver 404 may receive one or more remote and/or automatic control signal(s) which determine which way one or more of the body portions 902*b*, 904*a*, 906*a*, and 908*a* will move on the grid 622 and/or on one or more of the vertical posts 624, 626, 628, and/or 630. The computer processor 406 may process these one or more received signals from the transmitter/receiver 404 to cause the motor 402 to move the appropriate body portion of body portions 902*b*, 904*a*, 906*a*, and 908*a* in the appropriate direction along the grid 622 or up and down along the vertical posts 624, 626, 628 or 630, in accordance with computer programming stored in the computer memory 408.

The body portions 902*b*, 904*a*, 906*a*, and 908*a* may also be controlled through signals and/or electrical power provided through the grid 622 and/or the vertical posts 624, 626, 628, and/or 630. The body portions 902*b*, 904*a*, 906*a*, and 908*a* may alternatively or additionally include batteries for providing power for a motor 402 (for each of body portions 902*b*, 904*a*, 906*a*, and 908*a*) and/or for control circuitry, such as 404, 406, and 408 for each of body portions 902*b*, 904*a*, 906*a*, and 908*a*.

Figure 11:
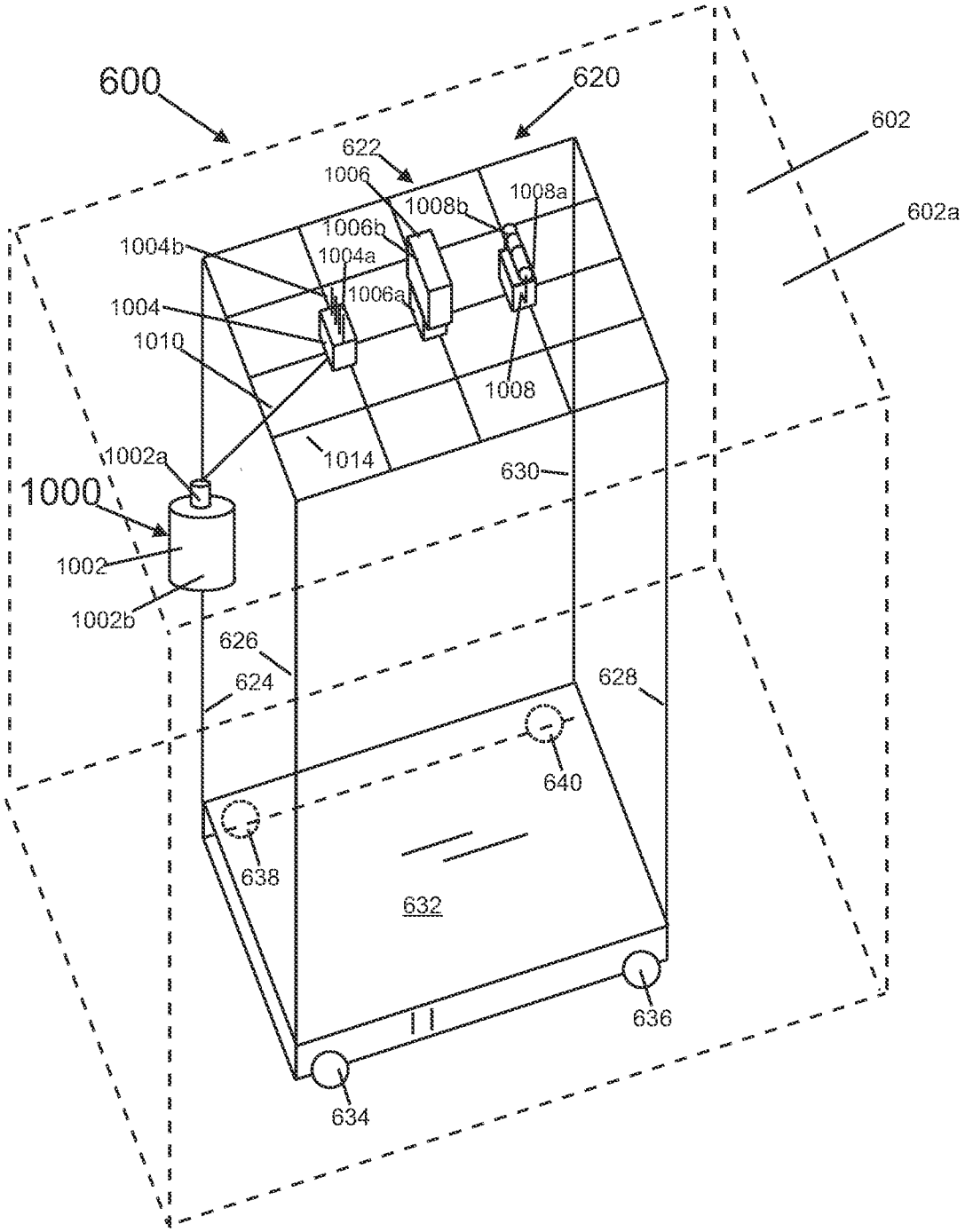
FIG. 11 shows a simplified diagram of a perspective view of the apparatus of FIG. 7, along with a second wall paper application apparatus, which is removably connected to the grid; and/or one or more of a plurality of vertical posts.

FIG. 11 shows a simplified diagram of a perspective view of the apparatus 600 of FIG. 7, along with a second wallpaper application apparatus 1000, which is removably connected to the grid 622 and/or the posts 624, 626, 628, and/or 630. The apparatus 1000 may be similar or identical to the apparatus 500 shown in FIG. 6, except as described below.

The wallpaper application apparatus 1000 may include a container device 1002, with container body portion 1002*b* and a pump and/or nozzle device 1002*a*. The container body portion 1002*b* includes an inner chamber in which wallpaper adhesive or glue is stored.

The apparatus 1000 also includes adhesive applicator device 1004, which includes member 1004*a* and bristles portion 1004*b*. The nozzle and/or pump device 1002*a* is connected by a tube 1010 to the member 1004*a*.

In operation, the adhesive is supplied from an inner chamber of the typically cylindrical container body portion 1002*b* through the nozzle and/or pump device 1002*a*, through the tube 1010, through member 1004*a* and onto the bristles portion 1004*b*. A free end of the bristles portion 1004*b* opposite an end connected to the member 1004*a* physically contacts the ceiling surface 602*a* to apply wallpaper adhesive to the ceiling surface 602*a*.

The apparatus 1000 further includes a wallpaper holder device 1006 including member 1006*a* and member 1006*b*. The member 1006*a* is connected to the grid 622.

The apparatus 1000 further includes a roller device 1008, which includes member 1008*a* connected to the grid 622 and roller 1008*b*, rotatably connected by arms to the member 1008*a*. After the wallpaper is applied to the adhesive on the ceiling surface 602*a* by the holder device 1006, the roller device 1008 rolls over the wallpaper located on the surface 602*a*, to smooth the wallpaper on the surface 602*a*.

Each of 1002, 1004, 1006, and 1008 may be moved anywhere on the grid 622 and/or the vertical posts 624, 626, 628, and/or 630. Each of 1002, 1004, 1006, and/or 1008 may have the apparatus 400 located thereon to control movement remotely and/or automatically on the grid 622. Each 1002, 1005, 1006, and 1008 may move along the tracks or effective tracks formed by the grid 622 and/or the vertical posts 624, 626, 628, and/or 630.

The body portions 1002*b*, 1004*a*, 1006*a*, and 1008*a* may also be controlled through signals and/or electrical power provided through the grid 622 and/or the vertical posts 624, 626, 628, and/or 630. The body portions 1002*b*, 1004*a*, 1006*a*, and 1008*a* may alternatively or additionally include batteries for providing power for a motor 402 (for each of body portions 1002*b*, 1004*a*, 1008*a*, and 1010*a*) and/or for control circuitry, such as 404, 406, and 408 for each of body portions 1002*b*, 1004*a*, 1008*a*, and 1010*a*.

The computer memory 408 of any of the painting devices 102, 104, 106, 108, 202, 204, 206, 208, 302, 304, 306, 308, 502, 504, 510, 508, 702, 704, 706, 708, 802, 804, 806, 808, 902, 904, 906, 908, 1002, 1004, 1006, and 1008 may include computer software for instructions to move the appropriate painting device automatically in a manner to paint a specific area of a wall and/or ceiling surface as appropriate. The computer memory 408 may also be used to paint a scenic view or natural picture depiction on a ceiling surface or wall surface. The computer memory 408 may have stored therein color templates with programmed images for painting. Multiple paint colors may be applied by the painting devices.

The painting apparatus shown in FIGS. 1-11 can also be used on exteriors of houses and/or structures. In at least one embodiment, the vertical posts 624, 626, 628, and 630 shown in FIG. 7 may be adjustable or have a telescoping so that the posts can set the grid 622 at different heights for painting. For example, each of the vertical posts 624, 626, 628, and 630 may actually be comprised of two or more concentric tubular parts which slide with respect to each other to cause a height to be raised or lowered.

The members 6*c*, 8*c*, 10*c*, 12*c*, 14*c*, 16*c*, 18*c*, and 20*c* may also be height adjustable or have a telescoping feature to raise the level of grid 3 or to expand the area covered by grid 3. For example, each of the members 6*c*, 8*c*, 10*c*, 12*c*, 14*c*, 16*c*, 18*c*, and 20*c* may actually be comprised of two or more concentric tubular parts which slide with respect to each other to cause a height to be raised or lowered.

The base 5 of FIG. 1 or the 632 of FIG. 7 may also be placed on scaffolding to raise the height.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a grid having a plurality of rows and columns;

a base, to which the grid is configured to be fixed;

a paint container; and a first painting device;

wherein the first painting device is attached to the grid and configured to move along the grid when attached to the grid, wherein each of the plurality of rows and columns of the grid functions as a track along which the first painting device is configured to move;

wherein the first painting device is connected to the paint container so that the first painting device is configured to receive paint from the paint container;

wherein the paint container is attached to the grid and configured to move along the grid when attached to the grid, wherein each of the plurality of rows and columns of the grid functions as a track along which the paint container is configured to move;

wherein the first painting device includes a first motor for moving the first painting device along the grid; and wherein the paint container includes a second motor for moving the paint container along the grid.

2. The apparatus of claim 1 wherein the first painting device includes a brush.

3. The apparatus of claim 1 wherein the first painting device includes a roller.

4. The apparatus of claim 1 wherein the first painting device includes a spray device.

5. The apparatus of claim 1 wherein the grid is configured to be fixed parallel to the base, when the base is parallel to a floor surface on which the base rests.

6. The apparatus of claim 1 wherein the grid is configured to be fixed perpendicular to the base, when the base is parallel to a floor surface on which the base rests.

7. The apparatus of claim 1 wherein the base has wheels for moving the base while the grid is fixed to the base.

8. The AR apparatus of claim 1 further comprising:

a second painting device;

wherein the second painting device is attached to the grid and configured to move along the grid when attached to the grid, wherein each of the plurality of rows and columns of the grid functions as a track along which the second painting device is configured to move; and wherein the second painting device is connected to the paint container so that the second painting device is configured to receive paint from the paint container;

wherein the second painting device includes a third motor for moving the second painting device along the grid.

9. The apparatus of claim 8 further comprising a roller for applying wall paper which is removably attached to the grid and configured to move along the grid when attached to the grid.

10. The apparatus of claim 8 further comprising a pressing device for applying pressure to wall paper wherein the pressing device is removably attached to the grid and configured to move along the grid when attached to the grid.

11. The apparatus of claim 1 wherein the first painting device includes a receiver configured to receive a remote control signal to cause the first painting device to move along the grid.

12. A method comprising:

automatically moving a first painting device along a grid to apply paint a to a surface in response to instructions from a computer processor as programmed by computer software in a computer memory;

wherein the grid has a plurality of rows and columns;

wherein the grid is fixed to a base;

wherein the first painting device is attached to the grid and configured to move along the grid when attached to the grid, wherein each of the plurality of rows and columns of the grid functions as a track along which the first painting device is configured to move; and wherein the first painting device is connected to a painting container so that the first painting device is configured to receive paint from the paint container;

wherein the paint container is attached to the grid and configured to move along the grid when attached to the grid, wherein each of the plurality of rows and columns of the grid functions as a track along which the painting container is configured to move;

wherein the first painting device includes a first motor for moving the first painting device along the grid; and wherein the paint container includes a second motor for moving the paint container along the grid.

13. The method of claim 12 wherein the first painting device includes a brush.

14. The method of claim 12 wherein the first painting device includes a roller.

15. The method of claim 12 wherein the first painting device includes a spray device.

16. The method of claim 12 wherein the grid is configured to be fixed parallel to the base when the base is parallel to a floor surface on which the base rests.

17. The method of claim 12 wherein the grid is configured to be fixed perpendicular to the base when the base is parallel to a floor surface on which the base rests.

18. The method of claim 12 wherein the base has wheels for moving the base while the grid is fixed to the base.

19. The method of claim 12 further comprising:

automatically moving a second painting device along the grid to apply paint to the surface in response to instructions from the computer processor as programmed by computer software in the computer memory;

wherein the second painting device is configured to receive paint from the paint container;

wherein the second painting device is attached to the grid and configured to move along the grid when attached to the grid, wherein each of the plurality of rows and columns of the grid functions as a track along which the second painting device is configured to move; and wherein the second painting device is connected to the paint container so that the second painting device is configured to receive paint from the paint container;

wherein the second painting device includes a third motor for moving the second painting device along the grid.

20. The method of claim 12 wherein the first painting device is made to move along the grid by remote control.

* * * * *